United States Patent [19]

Von Ruden

[11] 4,434,969

[45] Mar. 6, 1984

[54] ROD AND PIPE PUSHER-PULLER APPARATUS

[75] Inventor: Dennis Von Ruden, Owatonna, Minn.

[73] Assignee: General Equipment Co., Owatonna, Minn.

[21] Appl. No.: 282,428

[22] Filed: Jul. 13, 1981

[51] Int. Cl.[3] ..... E21B 19/00

[52] U.S. Cl. ..... 254/29 R

[58] Field of Search ..... 254/29 R, 30, 106; 294/92; 226/158, 162, 167

[56] References Cited

U.S. PATENT DOCUMENTS

| | | | |
|---|---|---|---|
| 1,049,402 | 1/1913 | Rydberg | 269/166 |
| 1,551,214 | 8/1925 | Perrel | 294/92 |
| 2,056,489 | 10/1936 | Scott et al. | 254/29 R |
| 2,221,325 | 11/1940 | Holman | 269/167 |
| 3,156,963 | 11/1964 | Owen | 254/106 |
| 3,227,419 | 1/1966 | Lackey . | |
| 3,620,503 | 11/1971 | Bro | 254/30 |
| 3,645,502 | 2/1972 | Stromp, Jr. . | |
| 3,726,506 | 4/1973 | Vanderwaal . | |
| 3,834,668 | 9/1974 | Casey . | |
| 3,907,253 | 9/1975 | Schosek | 254/29 R |
| 3,958,825 | 5/1976 | Diamond | 294/92 |
| 3,966,169 | 6/1976 | Schosek . | |
| 4,000,879 | 1/1977 | Martin . | |

FOREIGN PATENT DOCUMENTS

| | | | |
|---|---|---|---|
| 130818 | 1/1949 | Australia | 269/166 |
| 141806 | 4/1920 | United Kingdom | 269/167 |

*Primary Examiner*—Robert C. Watson

*Attorney, Agent, or Firm*—Merchant, Gould, Smith, Edell, Welter & Schmidt

[57] ABSTRACT

A rod and pipe pulling and pushing apparatus (10) for pulling or pushing a pipe or rod (22) through the ground. Apparatus (10) includes an elongated frame (12) with a carriage assembly (20) slideably mounted therein. The carriage assembly (20) includes a gripping means (24) for gripping a pipe or rod (22). The apparatus further has two hydraulic cylinders (80) for moving the carriage assembly (20) relative to the elongated frame (12). A rear guide plate (70) and a front guide plate (72) are present for guiding the pipe (22) in a proper direction.

6 Claims, 6 Drawing Figures

ROD AND PIPE PUSHER-PULLER APPARATUS

TECHNICAL FIELD OF THE INVENTION

The present invention relates to an apparatus for pushing or pulling a pipe or rod through the ground. More particularly, mechanisms for avoiding apparatus self-damage and mechanisms leading to easier and less costly maintenance of the apparatus are introduced.

BACKGROUND OF THE INVENTION

It is often necessary to lay a pipe or rod beneath existing highways or structures. The present invention allows conduits to be laid without tearing up the highway surface or interfering with the existing structure by avoiding the necessity of having to dig a trench for laying the pipe or rod in the ground. Rather, the present invention pushes or pulls a rod or pipe through the earth underneath the highway or structure.

Oftentimes the location where pipes or rods are to be placed in the ground is not very accessible. It is therefore desirable to have a portable rod and pipe pulling and pushing apparatus which will perform the above-described function and yet allow access to hard-to-get-at locations.

Several patents have issued on apparatus which perform the above-described function, examples of which are U.S. Pat. No. 3,227,419 (Lackey), U.S. Pat. No. 3,726,506 (Vanderwaal et al.), U.S. Pat. No. 3,834,668 (Casey), and U.S. Pat. No. 4,000,879 (Martin et al.). The apparatus of the prior art all have a frame with an assembly of sorts movable along the frame by various means. In addition, the previously mentioned prior art have various types of gripping mechanisms for gripping the rod or pipe which is being pulled or pushed, some of the embodiments revealing reversible mechanisms so that the apparatus from one position may either pull or push a rod or pipe.

Many of these devices have functioned adequately. The devices, however, must be operated carefully. Furthermore, the gripping mechanisms must be monitored frequently for unacceptable wear conditions. The present invention alleviates several operational and maintenance weaknesses of the known devices.

SUMMARY OF THE INVENTION

The present invention relates to a rod and pipe pulling and pushing apparatus. The rod and pipe pulling and rushing apparatus has an elongated frame with a carriage assembly movably mounted to the frame, the apparatus including means for moving the carriage assembly relative to the frame. The carriage assembly further includes means mounted thereon for gripping a rod or pipe, the gripping means being reversible to allow pulling or pushing of the pipe or rod. In addition, the apparatus includes means for guiding the pipe to assure movement of said pipe in a proper direction, the guide means including a front guide plate which yields upon impact of a bore-enlarging cup commonly attached to the end of pulled pipes.

In a preferred embodiment of the present invention, the rod and pipe pulling and pushing apparatus has an elongated rectangular frame with front and back end walls and side walls. A carriage assembly is slideably mounted on the frame for longitudinal movement. Two hydraulic cylinders provide the necessary force to move the carriage assembly relative to the frame. The carriage assembly has a pipe and rod gripping mechanism which includes a pair of gripping members pivotably mounted in a U-shaped pivot block thereby allowing vertical, lateral, and longitudinal movement as well as yaw and pitch movement of the gripping members.

The gripping members have a rectangular shaped insert holder with recesses therein for placement of replaceable and reversible inserts, the insert holder and inserts defining an aperture for passage therethrough of the rod or pipe. The aperture is shaped to have three contact points for engaging a pipe or a rod about its circumference during pushing or pulling. Each insert holder is attached to a cylindrical shaft pivotably retained by the U-shaped pivot blocks fixed to the carriage frame. Attached to the other side of the cylindrical shaft is a strap which extends vertically upward. A spring is connected between the strap and the carriage frame. The spring retains the gripping member in a pipe pulling or pushing position.

The rod and pipe pulling and pushing apparatus further includes a guide mechanism for guiding the pipe or rod in a proper direction. The guide mechanism includes a front guide plate with an aperture therein for passage therethrough of the rod or pipe. The front guide plate is yieldably attached with a pair of springs to the front end wall of the frame, whereby upon the impact of a bore enlarging cup commonly attached to the end of a rod or pipe being pulled or pushed, the front guide plate will move, thereby preventing damage to the apparatus.

The present invention provides a rod and pipe pulling and pushing apparatus which is portable, thereby allowing access to hard-to-get-at locations.

The gripping mechanism advantageously reduces wear to the working pipes or rods. Furthermore, the gripping mechanism itself wears out less frequently because of the reversible inserts used in each gripping member and the unique three point, pipe contact design. Even when the inserts wear out, replacement is very inexpensive since only the inserts need be replaced.

The front guide plate further reduces wear or damage that might occur to the apparatus during pulling through impact with the bore enlarging cup commonly attached to the end of a rod or pipe. The front guide plate is advantageously yieldable.

These and other various advantages and features of novelty which characterize the present invention are also pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is described a preferred embodiment of the invention.

BRIEF DESCRIPTION OF THE DRAWINGS

In the drawing, in which like reference numerals and letters indicate corresponding parts throughout the several views.

DETAILED DESCRIPTION OF THE INVENTION

Figure 1:
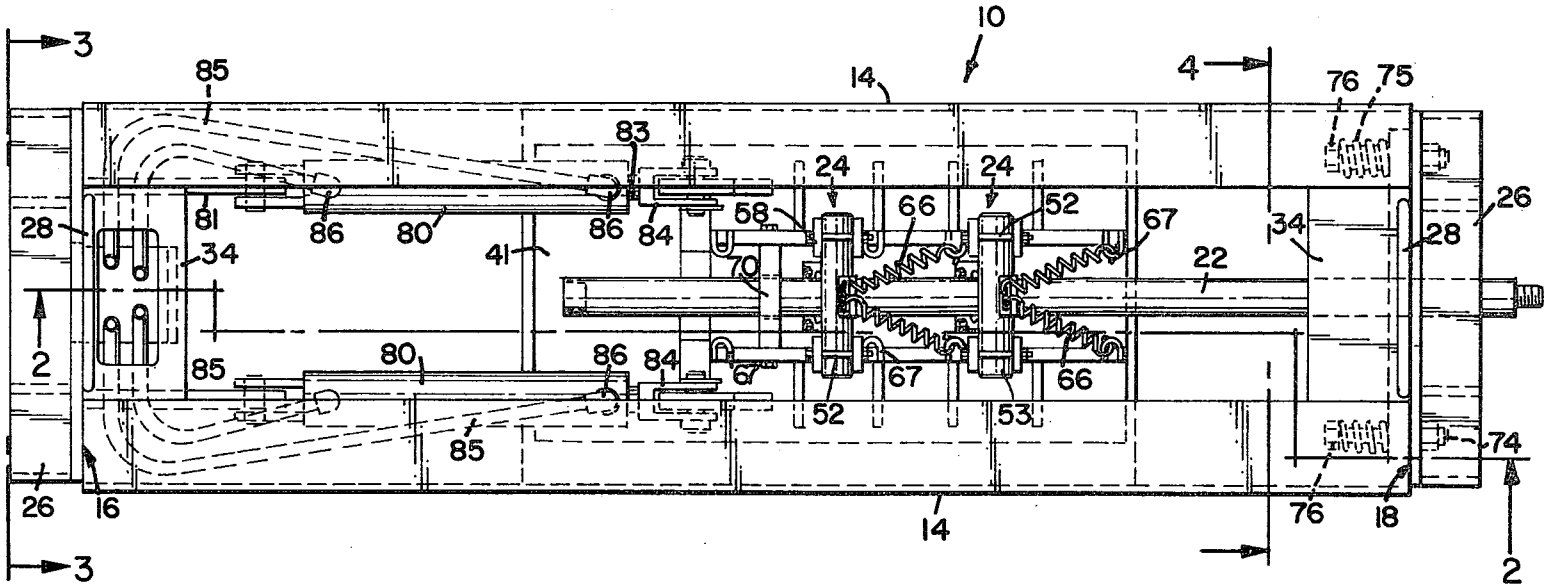
FIG. 1 is a top view of an apparatus in accordance with the present invention.
Figure 2:
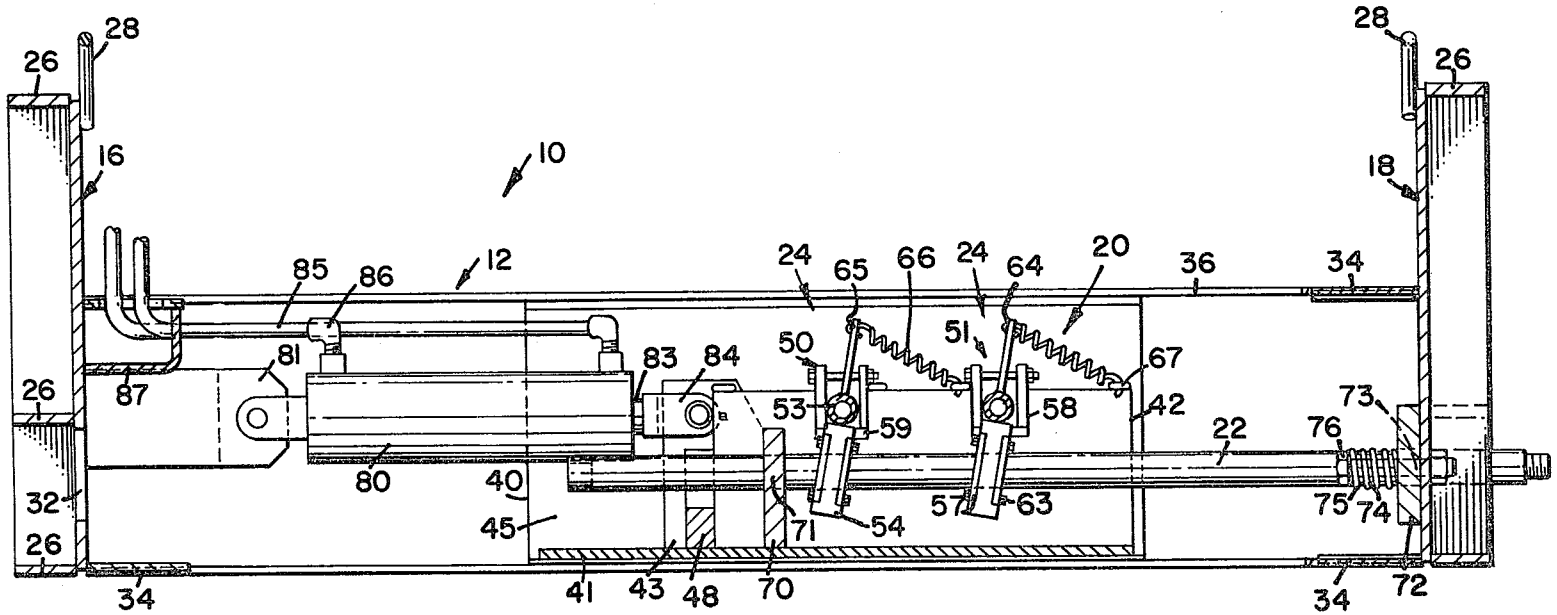
FIG. 2 is a cross-sectional view, taken along line 2—2 of FIG. 1.
Figure 3:
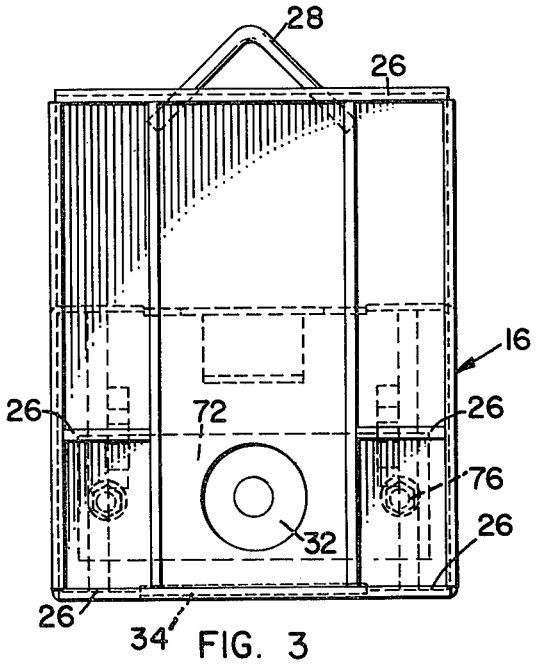
FIG. 3 is a rear, end view of the apparatus of FIG. 1.
Figure 4:
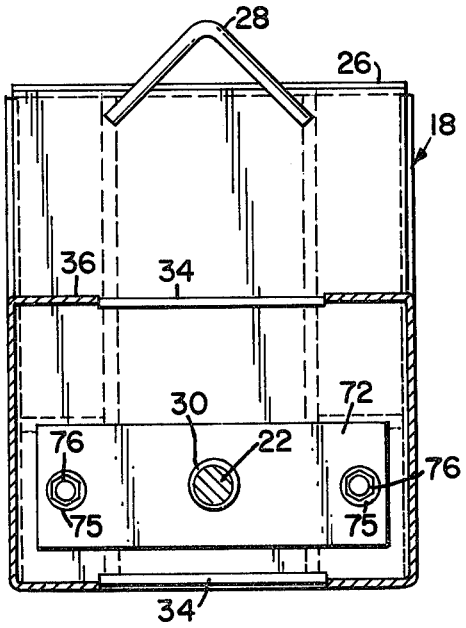
FIG. 4 is a cross-sectional view, taken along line 4—4 of FIG. 1.
Figure 5:
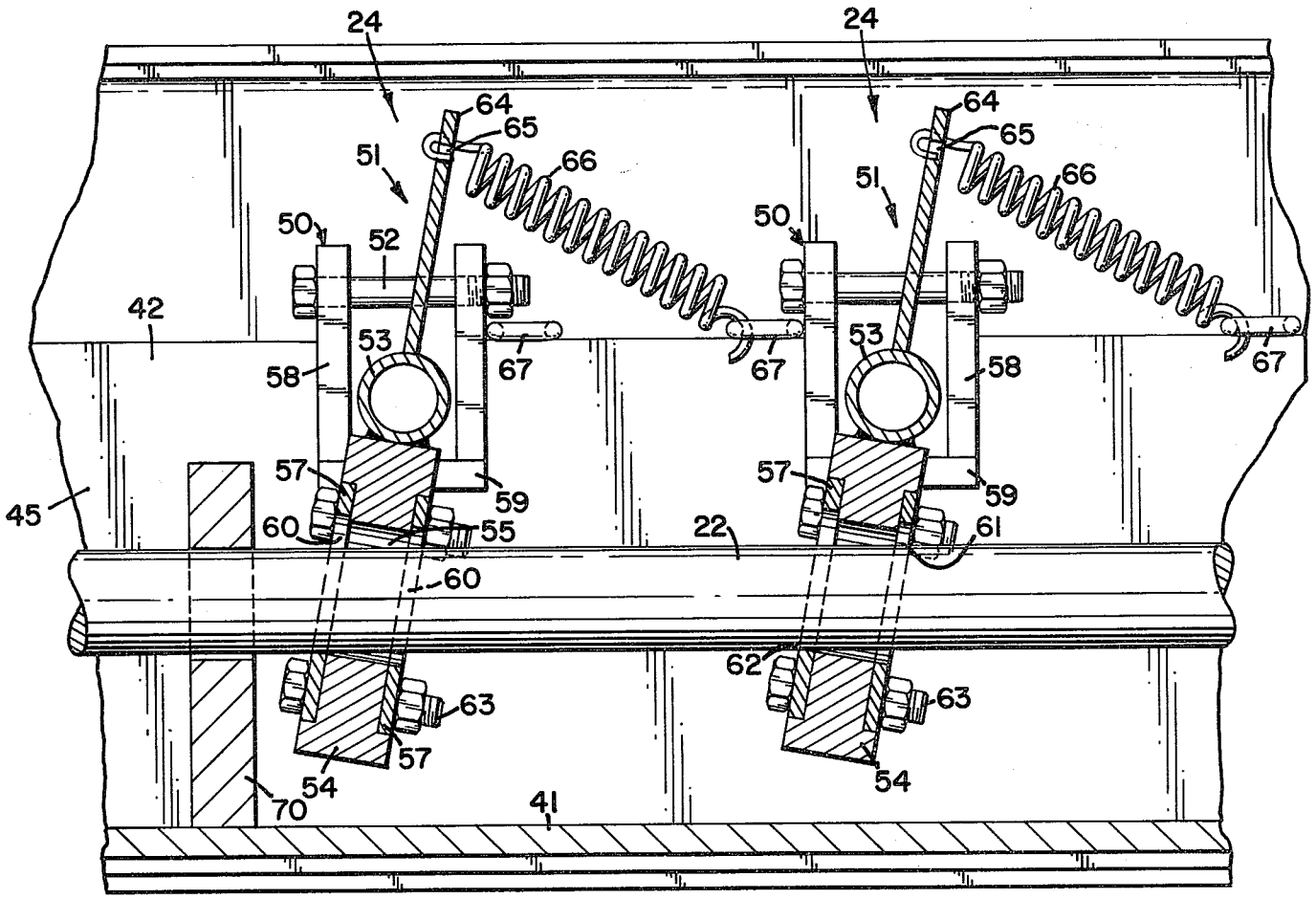
FIG. 5 is an enlarged detail of the gripping mechanism on the apparatus illustrated in FIGS. 1-4.

A preferred embodiment of a rod and pipe pulling and pushing apparatus 10 in accordance with the present invention is shown in FIGS. 1 and 2. Apparatus 10 has an elongated frame 12 with two side walls 14, a back wall 16, and a front wall 18. A carriage assembly 20 is slideably mounted on frame 12. The carriage assembly 20 includes a pair of gripping mechanisms 24, as shown in FIG. 5, for gripping a pipe or a rod 22. Apparatus 10 further has a pair of hydraulic cylinders 80 for moving carriage assembly 20 relative to frame 12. A rear guide plate 70 and a front guide plate 72 are present for guiding pipe 22 in a proper direction.

The vertically upright side walls 14 of elongated frame 12 connect back wall 16 and front wall 18. Back wall 16 and front wall 18 have vertically extending and horizontally extending plates 26 welded or otherwise attached to the outside surfaces for assisting in anchoring apparatus 10 against a dirt wall. Attached near the top and center of each of back wall 16 and front wall 18 is an inverted V-shaped lifting eye 28 for lifting apparatus 10, lifting eyes 28 extending above the top of walls 16 and 18. Front wall 18 and back wall 16 have apertures 30 and 32, respectively, for passage therethrough of the pipe 22. Cross support structures 34 interconnecting side walls 14 are located at the top and bottom of frame 12 adjacent to end walls 18 and 16 to provide additional structural support for frame 12. Side walls 14 are curved inwardly at the tops and bottoms to provide elongated frame 12 with channel side structures for allowing carriage assembly 20 to be moved slideably therein. It is understood, of course, that frame 12 and other structural items and assemblies of the present invention could have a number of other configurations as well.

The carrier assembly 20, slideably mounted on frame 12, has two longitudinal side structures 40 for engaging sides 14 of frame 12. Each side structure 40 comprises a longitudinal vertical wall bent inwardly at its top and bottom. Side structures 40 are interconnected at the bottoms by a plate 41. Two vertical plates 42 are welded or otherwise connected to the carriage bottom plate 41 and extend longitudinally of the carriage assembly 20. A structural support member 48, attached to bottom plate 41, extends transversely between side plates 42 to provide structural support and integrity. A pair of vertically upright plates 43 are welded or otherwise attached to bottom plate 41 to provide a carriage assembly attachment point for the hydraulic cylinders 80.

The gripping mechanisms 24, as shown in FIG. 5, are identical. Each includes a pair of spaced-apart, U-shaped pivot blocks 50 and a gripping member 51, gripping member 51 comprising a rectangular insert holder 54, two rectangular inserts 57, a hollow pivot cylinder 53, and a spring attach strap 64. The U-shaped pivot blocks 50 are formed with two vertically upright plates 58 separated by a horizontal plate 59. Each pivot block 50 is welded or otherwise attached to the top of a carriage side plate 42 such that vertical plates 58 are transversely perpendicular to side plates 42. Each pivot block 50 on one side plate 42 is laterally aligned with another on the opposite side plate 42. A bolt 52 or such similar hardware is used to interconnect the two vertical plates 58 of each U-shaped pivot block 50 near the top portion thereof, thereby retaining, but allowing removal of, the pivot cylinders 53 which are retained within the U-shaped pivot blocks 50.

The pivot cylinders 53 extend transversely between and are pivotably retained by a pair of U-shaped pivot blocks 50. Attached longitudinally to the outer surface of each pivot cylinder 53 along a portion thereof between the pivot blocks 50 is a rectangularly shaped insert holder 54 with an aperture 55 therein for passage therethrough of the pipe or rod 22. The insert holder 54 is suspended from pivot cylinder 53 and extends generally downwardly. The insert holders 54 have rectangular recesses on each side thereof, allowing a rectangular insert 57 to be positioned flush with the exterior surface of the insert holder 54.

Figure 6:
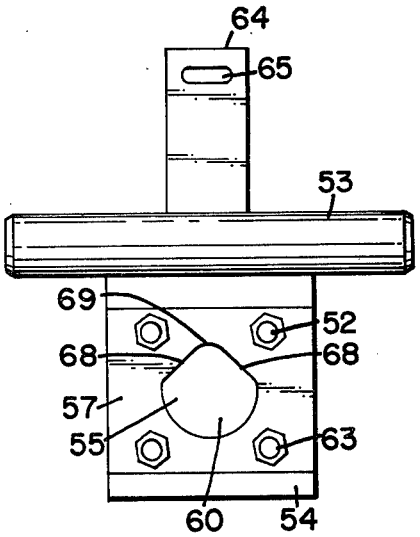
FIG. 6 is a detailed plan view of a gripping member.

The rectangular inserts 57 define an aperture 60 for passage therethrough of the rod or pipe 22. As shown in FIG. 6, aperture 60 is generally circular but has non-removed portions above a chord 68 on both sides of the uppermost point 69 of the generally circular shape. Thus, when a gripping member is inclined during operation, insert apertures 60 define two upper contact points 61 (see FIG. 5) along chords 68 on one insert 57 and one lower contact points 62 on the other insert 57 for engaging the pipe or rod 22 while pulling or pushing the rod or pipe 22. The inserts 57 are held in place on opposite sides of holder 54 by four insert bolt and nut combinations 63 or such similar attach hardware. Inserts 57 are easily reversible or replaceable by removal of bolt and nut combinations 63.

Attached longitudinally to the outer surface of a pivot cylinder 53 along a portion thereof directly above and opposite insert holder 54 and between U-shaped pivot blocks 50 is a vertically upward extending spring attach strap 64. Spring attach strap 64 is non-flexible and has an elongated aperture 65 near its top portion for attachment of two springs 66. Springs 66 are also attached to spring attach fittings 67 located at the top of opposite carriage side plates 42 either in front of or in back of a pivot block 50. When springs 66 are attached to the spring attach straps 64 and the spring attach fittings 67, the gripping members 51 are held in either a pipe pushing or a pipe pulling position depending on whether springs 66 are attached in front of or in back of pivot blocks 50, respectively.

When springs 66 are engaged in either a pipe pulling or pushing position, there is clearance between the outer circumference of a pivot cylinder 53 and the bottom plate 59 and at least one side plate 58 of pivot blocks 50. When springs 66 are detached from the spring attach fittings 67, the pivot cylinders 53 are held by U-shaped blocks 50 such that rod or pipe 22 can be easily inserted into or disengaged from the gripping members 51 by horizontally moving pipe 22 with respect to gripping members 51.

The front guide 72 and the rear guide 70 support and guide rod or pipe 22 in a proper direction. Both have apertures 73, 71 therein, respectively, for passage therethrough of rod or pipe 22. The rear guide 70 is attached to the carriage bottom plate 41 and vertically extends therefrom. The rear guide 70 is positioned between the back wall 16 and the gripping mechanism 24 so as to be in general alignment with the gripping members 51 and the front guide 72. The front guide 72 is attached on the inside of elongated frame 12 to the front wall 18 over front aperture 30. The front guide 72 is attached to the front wall 18 by two attaching bolts 74 or other similar attaching hardware. Coil springs 75 displace the heads of bolts 76 from the front guide 72, thereby yieldably attaching front guide 72 to front wall 18. Upon impact of a bore enlarging cup which is commonly attached to an end of rod or pipe 22 being pulled, with front guide 72, the front guide 72 moves, thereby avoiding damage to front wall 18 or other portions of apparatus 10. Aperture 30 in front wall 18 is, of course, sufficiently large to allow commonly used bore-enlarging cups to pass through so as to avoid front wall 18 and impact front guide 72.

The two hydraulic cylinders 80 which move carriage assembly 20 relative to elongated frame 12 are located between assembly 20 and back wall 16. Hydraulic cylinders 80 are fastened at one end to brackets 81 which are welded or otherwise attached to back wall 16. The pistons 84 at the other end of hydraulic cylinders 80 are fastened to cylinder attach plates 43. Hydraulic hoses 85 are connected to cylinders 80 with fittings 86. The hydraulic hoses 85 exit from elongated frame 12 through a hose protection bracket 87 which is an L-shaped bracket connected to back wall 16 and cross support structure 34. Hydraulic hoses 85 extend to a hydraulic control mechanism located external of elongated frame 12.

In operation, a ditch or other excavated opening is dug adjacent a roadway under which an opening is to be bored. Apparatus 10 is conveniently lowered into the ditch by using lifting eyes 28. The rear wall 16 of apparatus 10 is placed against the side of the excavation opposite the roadway. The various hydraulic connections are made as know to those skilled in the art. Hydraulic cylinders 80 are operated to retract pistons 83 and move carriage assembly 20 to its most rearward position. With springs 66 unattached, a first section of rod 22 is inserted through aperture 71 of rear guide 70 and then through apertures 55 and 60 of insert holders 54 and insert 57 of gripping members 51. Rod 22 is further moved through aperture 73 of front guide 72. Springs 66 are then attached to the forward spring attach fittings 67. In this configuration, the forwardmost insert 57 of each gripping member 51 makes contact at a point along each chord 69. The rearward insert makes contact at a single point near the bottom of aperture 60. As hydraulic cylinders 80 are operated, gripping members 51 bind against rod 22 and extend it in direct relation with the extension of pistons 84 of cylinders 80. If the rear end of rod 22 has not been pushed sufficiently forwardly to a location near rear guide 70, then cylinders 80 are retracted to allow gripping members 51 to rebind at a more rearward location so as to extend rod 22 further forward. As pistons 83 of cylinders 80 retract, gripping members 51 do not bind, but rather slide along rod 22. When the first section of rod 22 has been pushed as far as possible, a second rod section is positioned between cylinders 80. A portion of the second section of rod 22 may have to be extended rearwardly through aperture 32 in rear wall 16 before the first and second sections of rod 22 may be fastened together. Cylinders 80 are then again operated as just described. Additional sections of rod 22 are used as required until the forward end of rod 22 reaches the far side of the roadway.

Usually a bore larger than pipe 22 is required. Thus, it is often appropriate to attach a bore-enlarging cup on the free forward end of pipe 22 and pull it back to apparatus 10. Pulling is accomplished by moving springs 66 from a position forward of gripping members 51 to a position rearward of them. Gripping members 51 then slide freely as pistons 84 of cylinders 80 extend, while binding when pistons 80 are retracted. During retraction, a point along each chord 69 of the rearward inserts 57 contacts pipe 22 while a single point near the bottom of forward inserts 57 binds against the lower portion of pipe 22. When pipe 22 has been pulled sufficiently to allow removal of a section, such section is unfastened and removed from the region between cylinders 80.

When pulling pipe 22, front wall 18 moves forwardly to contact the side of the excavation most near the roadway. Thus, during a pulling operation, it is often difficult to know when the bore-enlarging cup is approaching front wall 18. It has not been uncommon for prior machines to suffer severe damage when the cup impacted the forward wall while the cylinders continued to operate. The present invention advantageously eliminates the risk of such damage since the bore enlarging cup may pass through aperture 30 of front wall 18 to impact front guide member 72. Since front guide member 72 is yieldably attached to front wall 18, member 72 moves when contacted by the bore enlarging cup. Such movement is easily seen by the operator of apparatus 10 who then has time to stop further operation of hydraulic cylinders 80 thereby avoiding damage to apparatus 10.

The performance of apparatus 10 is particularly good because of the self-aligning capability of gripping mechanisms 24 relative to the guiding function accomplished by rear guide 70 and yieldable front guide 72. Guide members 51 are free to move vertically and laterally within the limits of pivot block 50 and bolts 52. Thus, gripping mechanisms 24 essentially float while performing the pushing or pulling function and allowing the front and rear guides to perform the guiding function.

Gripping mechanisms 24 operate reliably because of springs 66 constant holding of gripping members 51 in a binding orientation for either pushing or pulling. Gripping members 51 grip rapidly thereby eliminating chatter wear along rod or pipe 22. Furthermore, gripping members 51 make contact at three points thereby reducing the depth of bite when compared with mechanisms which bind at only two contact points. As inserts 57 wear, they are easily reversed to eliminate costly replacement. When inserts 57 become worn, replacement is easily accomplished without having to replace more expensive assemblies as in prior art devices.

Thus, numerous characteristics and advantages of the invention have been set forth in the foregoing description, together with details of the structure and function of the invention. The novel features thereof are pointed out in the appended claims. The disclosure, however, is understood to be illustrative only, and changes to the described embodiment may be made in detail, especially in matters of shape, size, and arrangement of parts, within the principle of the invention, to the full extent indicated by the broad general meaning of the terms in which the appended claims are expressed.

What is claimed is:

1. A rod and pipe pulling and pushing apparatus, comprising:

(a) an elongated frame having a front end and a back end;

(b) a carriage assembly moveably mounted to said frame;

(c) means for reversibly moving said carriage assembly relative to said frame;

(d) means mounted on said carriage assembly, for gripping said pipe, said pipe being movable in a longitudinal direction with respect to said frame; and (e) means for guiding said pipe, said guide means including a longitudinally yieldable front guide plate attached near said front end, whereby said front guide plate yields thereby signaling impact by a bore enlarging cup commonly attached to a pipe being pulled to allow stopping of said moving means to prevent damage to said apparatus.

2. A rod and pipe pulling and pushing apparatus in accordance with claim 1, wherein said guide means further includes a spring resiliently attaching said front guide plate to said front end of said frame, said spring being mounted longitudinally to allow longitudinal deflection of said guide plate.

3. A rod and pipe pulling and pushing apparatus in accordance with claim 1, wherein said guide means further comprises a rear guide plate attached to said carriage assembly, said rear guide plate having an aperture therein for passage therethrough of said pipe, whereby said rear guide plate and said front guide plate function to guide said pipe in a proper direction while said pipe is being pushed and pulled.

4. A rod and pipe pulling apparatus, comprising:

(a) an elongated frame having a front end and a back end;

(b) a carriage assembly slideably mounted on said frame;

(c) means for reversibly moving said carriage assembly relative to said frame;

(d) means, mounted on said carriage assembly, for gripping said pipe, said gripping means including two gripping members, each of said gripping members defining an aperture having three contact points for engaging said pipe, each of said gripping members having first and second insert members, said first insert member providing one contact point with said pipe and said second insert member providing two contact points with said pipe, said first and second insert members being reversible and interchangeable, said gripping means further including means for attaching said insert members to said gripping members; and (e) means attached to said apparatus for guiding said pipe in a proper direction, whereby said carriage assembly is slid by said moving means along said elongated frame in a pipe pulling or pushing direction such that said pipe is guided by said guiding means in a proper direction, said pipe being inserted in the aperture of the gripping members of the gripping means so as to be engaged by the two sets of three contact points.

5. An apparatus for pulling and pushing rod and pipe, comprising:

(a) a frame having a front end and a back end;

(b) a carriage assembly slidably mounted on said frame for movement along said frame;

(c) means for reciprocally moving said carriage assembly relative to said frame;

(d) means mounted on said carriage assembly for gripping said pipe, said gripping means being self-alignable, said gripping means including a pivotable gripping member having an insert holder and a replaceable and reversible insert member attached to both sides of said holder, said insert members having apertures, the apertures being substantially circular with non-removed portions above chords on both sides of an uppermost point of the aperture, whereby when said gripping member pivots, one said insert member contacts said rod at two points and another said insert member contacts said rod at one point; and (e) means attached to said carriage for guiding said pipe in a proper direction, whereby said insert members can be easily replaced or reversed should surfaces become worn.

6. An apparatus for pulling and pushing rod and pipe, comprising:

(a) an elongated frame having a front end and a back end;

(b) a carriage assembly slideably mounted on said frame for longitudinal movement along said frame;

(c) a hydraulic cylinder for reciprocally moving said carriage assembly relative to said frame;

(d) means mounted on said carriage assembly for gripping said pipe, said gripping means including two pivotably mounted gripping members, each of said gripping members defining an aperture and including two replaceable and reversible insert members, each set of two of said insert members defining three gripping contact points for engagement of said pipe;

(e) a front guide plate longitudinally yieldably attached to the front end of said frame, whereby said front guide plate yields upon impact of a bore-enlarging cup commonly attached to the end of said pipe during a pulling operation; and (f) a rear guide plate cooperating with said front guide plate to properly direct said rod or pipe.

* * * * *

UNITED STATES PATENT AND TRADEMARK OFFICE

CERTIFICATE OF CORRECTION

PATENT NO. : 4,434,969

DATED : March 6, 1984

INVENTOR(S) : Dennis Von Ruden

It is certified that error appears in the above-identified patent and that said Letters Patent is hereby corrected as shown below:

Column 1, line 48, delete "rushing" and insert therefor --pushing--.

Column 3, line 39, delete "carrier" and insert therefor --carriage--.

Column 4, line 24, delete "points" and insert --point--.

Column 5, line 31, delete "know" and insert therefor --known--.

Claim 4, line 1, after "pulling" insert --and pushing--.

Signed and Sealed this

*Seventh* Day of *August 1984*

[SEAL]

*Attest:*

GERALD J. MOSSINGHOFF

*Attesting Officer*

*Commissioner of Patents and Trademarks*